US009032650B2

(12) United States Patent
Iacona

(10) Patent No.: US 9,032,650 B2
(45) Date of Patent: May 19, 2015

(54) REMOVABLE PLOW ATTACHMENT FOR SNOW BLOWER

(71) Applicant: Ignazio Iacona, Flushing, NY (US)

(72) Inventor: Ignazio Iacona, Flushing, NY (US)

( * ) Notice: Subject to any disclaimer, the term of this patent is extended or adjusted under 35 U.S.C. 154(b) by 134 days.

(21) Appl. No.: 13/798,514

(22) Filed: Mar. 13, 2013

(65) Prior Publication Data

US 2013/0239447 A1 Sep. 19, 2013

Related U.S. Application Data

(60) Provisional application No. 61/610,310, filed on Mar. 13, 2012.

(51) Int. Cl.

| | |
|---|---|
| ***E01H 1/00*** | (2006.01) |
| ***E01H 5/04*** | (2006.01) |
| *E01H 5/06* | (2006.01) |
| *E01H 5/09* | (2006.01) |

(52) U.S. Cl.
CPC .. *E01H 5/04* (2013.01); *E01H 5/06* (2013.01); *E01H 5/09* (2013.01)

(58) Field of Classification Search
CPC ..... E01H 6/00; E01H 5/00; E01H 5/04; E01H 5/045; E01H 5/06; E01H 5/09; E02F 3/80; E02F 3/815; E02F 3/64
USPC ..... 37/231, 252, 270, 271, 242, 266, 214
See application file for complete search history.

(56) References Cited

U.S. PATENT DOCUMENTS

| | | | | |
|---|---|---|---|---|
| 2,032,487 | A | 3/1936 | Anderson | |
| 2,754,601 | A | 7/1956 | Meyer | |
| 3,233,350 | A * | 2/1966 | Malzahn et al. | 172/273 |
| D211,595 | S | 7/1968 | Kaufman | |
| 3,760,883 | A | 9/1973 | Birk | |
| 4,023,287 | A | 5/1977 | de Brito | |
| 4,354,321 | A | 10/1982 | Weatherholt | |
| 4,450,635 | A | 5/1984 | Shwayder | |
| 4,459,769 | A | 7/1984 | Willis, Sr. | |
| 4,607,781 | A * | 8/1986 | Shwayder | 228/175 |
| 4,712,623 | A * | 12/1987 | Martinez | 172/817 |
| 4,944,104 | A | 7/1990 | Kowalczyk | |
| 5,014,452 | A | 5/1991 | Berghefer | |
| 5,410,824 | A * | 5/1995 | Pedersen | 37/242 |
| 5,720,122 | A | 2/1998 | McLellan | |
| 6,247,254 | B1 | 6/2001 | Wessman | |
| 6,474,007 | B1 * | 11/2002 | Sueshige et al. | 37/266 |
| 6,581,307 | B1 * | 6/2003 | Jones et al. | 37/281 |
| 6,874,260 | B2 | 4/2005 | Mullett | |
| 7,735,247 | B2 | 6/2010 | Schmeichel | |

(Continued)

*Primary Examiner* — Robert Pezzuto
*Assistant Examiner* — Jessica H Lutz
(74) *Attorney, Agent, or Firm* — Gerald E. Hespos; Michael J. Porco; Matthew T. Hespos

(57) ABSTRACT

A removable plow attachment for a snow blower or thrower is provided. A plow attachment includes a plow member and hook-shaped brackets. The plow member is an arcuate shaped member configured for moving or plowing loose material such as snow, slush, etc. The plow member is removably coupled to the snow blower by the hook-shaped brackets and fasteners. L-shaped angling members are provided on the plow member. The brackets and the L-shaped angling members are configured so that the angle of the plow member relative to the snow blower and the surface being plowed can be adjusted.

14 Claims, 8 Drawing Sheets

(56) References Cited

U.S. PATENT DOCUMENTS

| | | | | |
|---|---|---|---|---|
| 2003/0140527 | A1 | 7/2003 | Pariseau | |
| 2003/0182824 | A1 | 10/2003 | Coffin | |
| 2004/0250454 | A1 | 12/2004 | Jager | |
| 2005/0005479 | A1 | 1/2005 | Strait | |
| 2006/0150443 | A1 | 7/2006 | Angeletti | |
| 2007/0245600 | A1 | 10/2007 | Hamel | |
| 2010/0236106 | A1 | 9/2010 | Muscarella | |
| 2012/0279093 | A1* | 11/2012 | Niemela et al. | 37/242 |
| 2013/0298429 | A1* | 11/2013 | Niemela et al. | 37/242 |
| 2014/0130384 | A1* | 5/2014 | Favorito et al. | 37/242 |

* cited by examiner

REMOVABLE PLOW ATTACHMENT FOR SNOW BLOWER

CROSS-REFERENCE TO RELATED APPLICATION

This application claims priority on U.S. Provisional Patent Appl. No. 61/610,310 filed on Mar. 13, 2012, the entire disclosure of which is incorporated herein by reference.

BACKGROUND

1. Field of the Invention

The present disclosure relates generally to snow removal equipment, and more particularly, a removable plow attachment for a snow blower or thrower.

2. Description of the Related Art

Motor driven snow removal equipment such as snow blowers or snow throwers are known in the art. Such snow removal equipment will usually take the form of a housing containing a rotating spiral blade, driven by a small gasoline engine, which forces the snow into a chute with sufficient force to cause it to be thrown a significant distance in a direction determined by the aiming of the chute. The most commonly used snow blower is of the type provided with a pair of drive wheels with the driving motor situated over the axle interconnecting these wheels. The housing and blade is situated forward of the wheels and with the blade connected to the drive motor via a belt. In use, the operator stands to the rear of the apparatus and, via suitable controls, adjusts the speed of the motor and the discharge direction of the chute while steering the blower with a pair of rearwardly extending handles.

Snow blowers are designed to facilitate the removal of comparatively deep and also dry snow. For snow of a wet consistency, slush, or a dusting, there is a tendency for the snow to stick to the sides of and thus clog the discharge chute of a snow blower thus rendering the apparatus useless. Furthermore, in relatively deep wet snow or slush, there is a tendency for the rotating blade to jam or get stuck resulting in problems for the driving motor, such as the motor burnout, breaking drive belts. etc. Additionally, in view of the force with which the snow is expelled from the discharge end of the chute, use of a snow blower for wet snow, slush or a dusting can result in damage to valuable shrubbery as well as glass such as automobile and building windows.

Thus, it is quite common for the owner of a snow blower to nevertheless resort to at least partial shoveling of the area containing wet snow, slush, or a dusting. It would be advantageous if motor driven snow removal equipment, as described above, can be employed to shovel or plow such wet snow, slush, or a dusting. Therefore, a need exists for an attachment to 95% of conventional motor driven snow removal equipment to enable the motor driven snow removal equipment to plow wet snow, slush, or a dusting. A further need exists for such attachment to be easily attached and/or removed from snow removal equipment, i.e., easy on/easy off.

SUMMARY

A removable plow attachment for a snow blower or thrower is provided.

A plow attachment in accordance with the present disclosure includes a plow member and hook shaped bracket members. The plow member is an arcuate shaped member configured for moving or plowing loose material such as snow, slush, etc. Vertical portions of the hook-shaped brackets are coupled to the plow member and horizontal portions of the hook-shaped brackets are coupled to the snow blower. L-shaped angling brackets are provided on the plow member and can be adjusted to alter the angle of the blade. The blade member is further adjustable relative to a surface being plowed.

The plow attachment is coupled to a snow blower via a plurality of fasteners, such as bolts and wing nuts, to facilitate quick and easy attachment and/or removal. Rubber mounts are provided between the plow member and the snow blower housing to absorb shock and prevent damage to the plow member and the snow blower housing. The plow attachment is preferably adaptable to 95% of snow blowers.

The above and other aspects, features, and advantages of the present disclosure will become more apparent in light of the following detailed description when taken in conjunction with the accompanying.

DETAILED DESCRIPTION OF THE PREFERRED EMBODIMENTS

Figure 1:
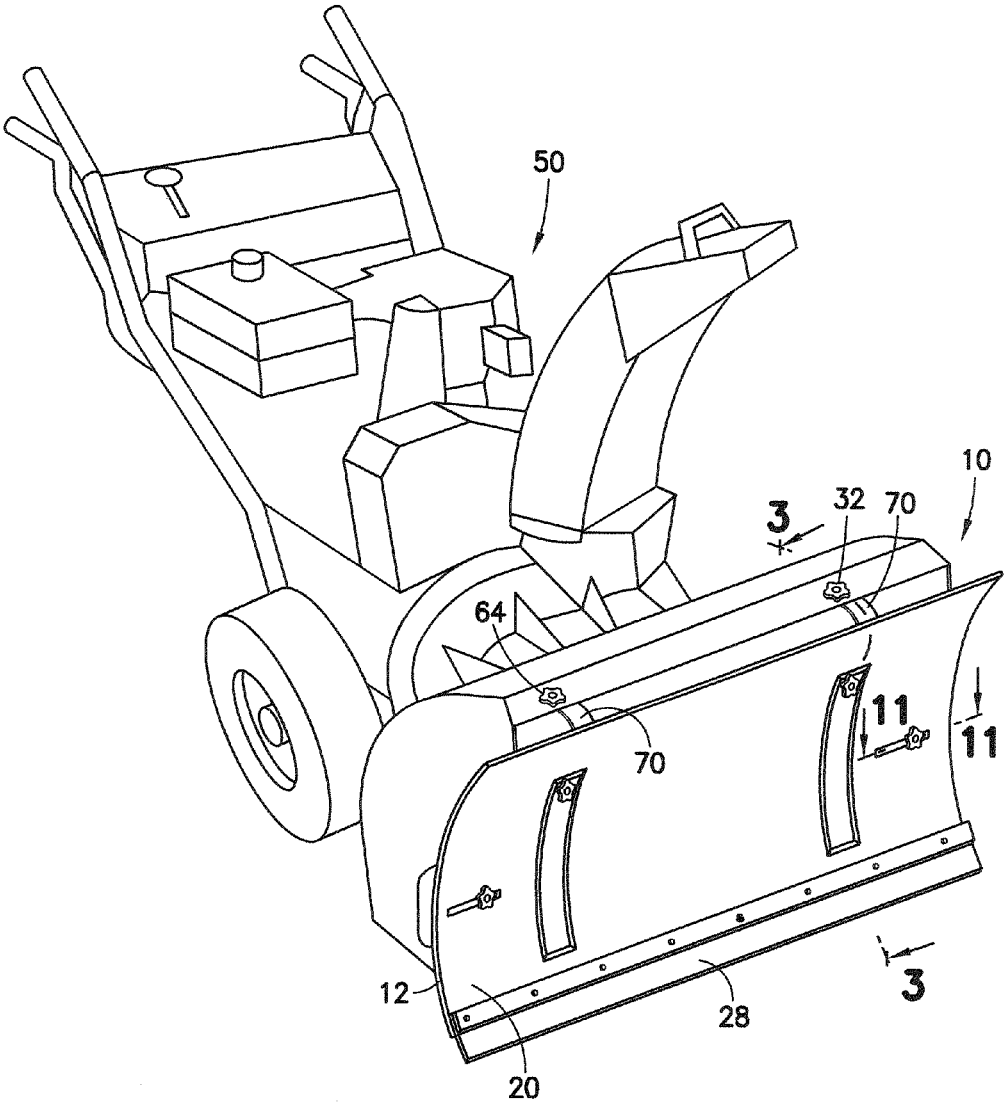
FIG. 1 is a perspective view of a removable plow attachment coupled to a snow blower in accordance with an embodiment of the present disclosure.

Preferred embodiments of the present disclosure will be described hereinbelow with reference to the accompanying drawings. In the following description, well-known functions or constructions are not described in detail to avoid obscuring the present disclosure in unnecessary detail.

Referring to the Figures, a removable plow attachment 10 for a snow blower 50 is illustrated. The plow attachment 10 includes a plow member 12 and first and second hook-shaped brackets 70. The plow member 12 is preferably flexible and is configured for moving or plowing loose material such as snow, slush, etc. The plow member 12 is removably coupled to the snow blower 50 by the first and second hook-shaped bracket 70 and a plurality of fasteners 32 (e.g., a bolt and nut).

The plow member 12 has a top edge 14 and a bottom edge 16 and parallel side edges 18 extending therebetween. The plow member 12 is preferably arcuately shaped and has opposite concave and convex surfaces 20, 22. First and second openings 24 are provided between the concave and convex surfaces 20, 22 and are configured for the fasteners 32 to pass through. In certain embodiments, the plow member 12 includes a rubber member 28, or squeegee-type member, running along the bottom edge 16 and extending toward the surface to be plowed. The rubber member 28 will enable the plow member 12 to be located close to the surface to be plowed but will absorb impact from any object on the surface to avoid damage to the plow member 12 or plow attachment 10. The rubber member 28 preferably has a pre-selected rigidity to allow the rubber member 28 to push snow, slush and the like, while also flexing enough to allow the rubber member 28 to pass over rocks, debris, and other impediments. Further, a height of the rubber member 28 may be adjusted, so that the rubber member 28 can be lowered when it becomes worn. Still further, the rubber member 28 is configured to be easily replaced.

Figure 2:
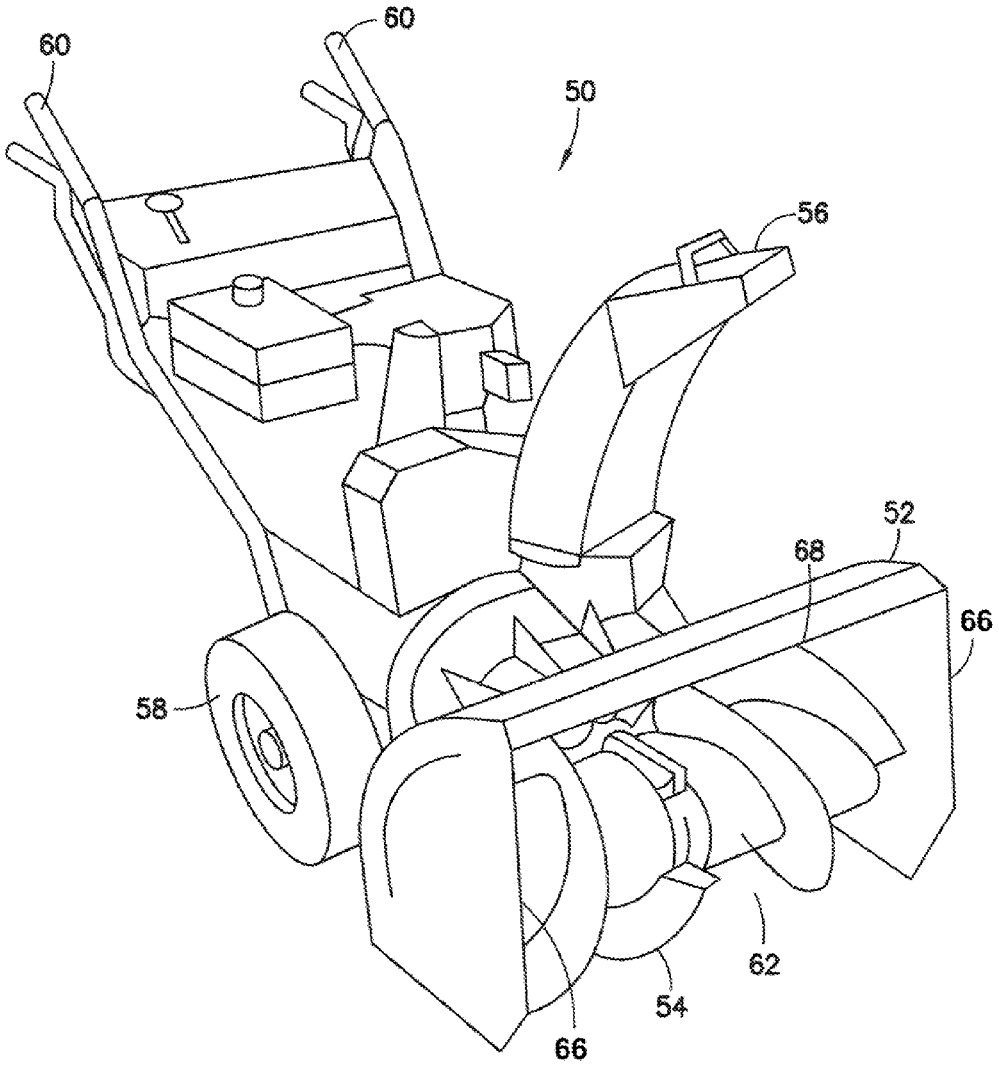
FIG. 2 is a perspective view of a conventional snow blower.

Referring to FIG. 2, a conventional snow blower 50 is illustrated. The snowblower 50 includes a housing 52 containing a rotating spiral blade 54, driven by a small gasoline engine, which forces the snow into a chute 56 with sufficient force to cause it to be thrown a significant distance in a direction determined by the aiming of the chute 56. The snow blower 50 further includes a pair of drive wheels 58 with the driving motor situated over the axle interconnecting these wheels. The housing 52 and blade 54 is situated forward of the wheels 58 and with the blade 54 connected to the drive motor via a belt. In use, the operator stands to the rear of the snow blower 50 and, via suitable controls, adjusts the speed of the rotor and the discharge direction of the chute 56 while steering the blower with a pair of rearwardly extending handles 60. The housing 52 has a front open portion 62 through which snow enters and contacts the blade 54. The open portion 62 of the housing 52 is defined by a top peripheral edge 68 and two side peripheral edges 66. First and second openings 64 are provided in the housing 52 near the top peripheral edge 68 and are configured to allow the fasteners 32 to pass therethrough.

Referring to FIG. 1, the plow attachment 10 is illustrated coupled to the snow blower 50. The plow attachment 10 is disposed over the front open portion 62 of the housing 52. The first and second hook-shaped brackets 70 are disposed between the plow member 12 and the housing 52. A plurality of fasteners 32 (e.g., a bolt and nut) are provided for removably coupling the plow member 12 to the housing 52 via the hook-shaped brackets 70.

The first and second hook-shaped brackets 70 comprise a substantially vertical portion 72 integrally formed with a substantially horizontal portion 82. The substantially vertical portion 72 has a distal end 74 remote from the horizontal portion 82. An elongated slot 76 is provided between the substantially horizontal portion 82 and the distal end 74 of the vertical portion 72. The elongated slots 76 align with the first and second openings formed in the plow member 12 when the brackets 70 are coupled to the plow member 12. Preferably, the substantially vertical portion 72 has an arcuate shape and is configured so that the convex surface 22 of the plow member 12 can nest with the substantially vertical portion 72.

The substantially horizontal portion 82 has a distal end 84 remote from the substantially vertical portion 72. An elongated slot 86 is formed in the substantially horizontal portion 82 between the vertical portion 72 and the distal end 84 of the horizontal portion 82 and is configured for receiving the fastening member 32. The elongated slots 86 align with the first and second openings 64 formed in the snow blower housing 52 when the plow attachment 10 is mounted to the housing 50. The substantially horizontal portion 82 preferably has an arcuate shape and is configured to nest in the top surface of the housing 52.

In the preferred embodiment, the plurality of fasteners 32 comprises plow member coupling fasteners 34 and snow blower housing coupling fasteners 40. The plow member coupling fasteners 34 are preferably carriage bolts 36 and have knobs 38 attached thereto. The carriage bolts 36 are inserted through the elongated slots 76 in the vertical portion 72 of the bracket 70 and through the openings 24 in the plow member 12. The knobs 36 are attached to the bolts 34 and allow the bracket 70 and housing 12 to be tightly fastened to each other.

Figure 8:
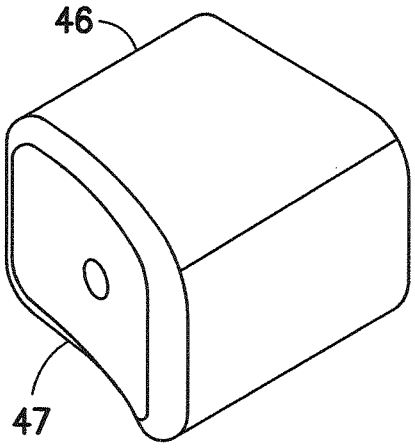
FIG. 8 is a perspective view of an alternate embodiment of a rubber mount.
Figure 9:
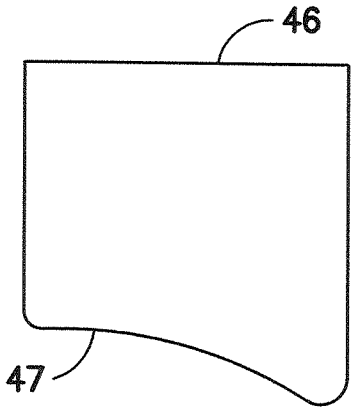
FIG. 9 is a side view of the rubber mount of FIG. 8.
Figure 10:
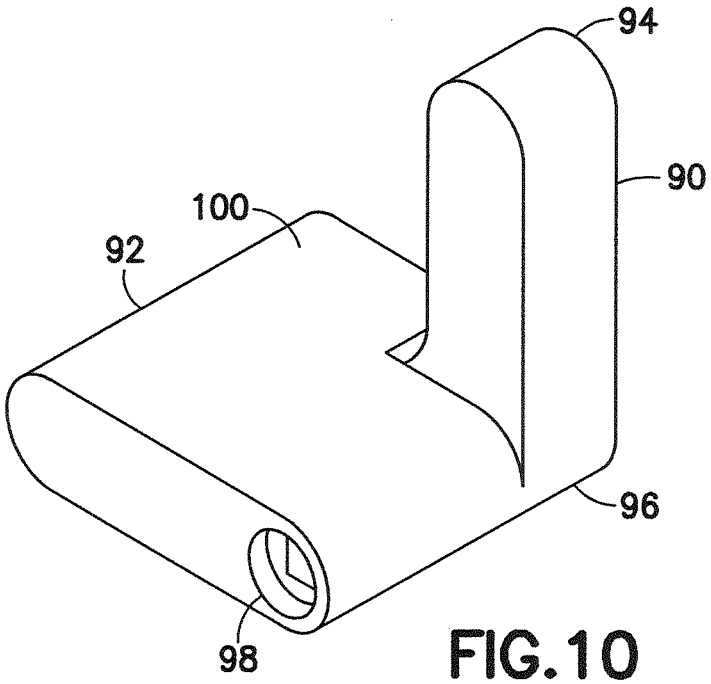
FIG. 10 is a perspective view of an L-shaped angling member in accordance with an embodiment of the present disclosure.
Figure 11:
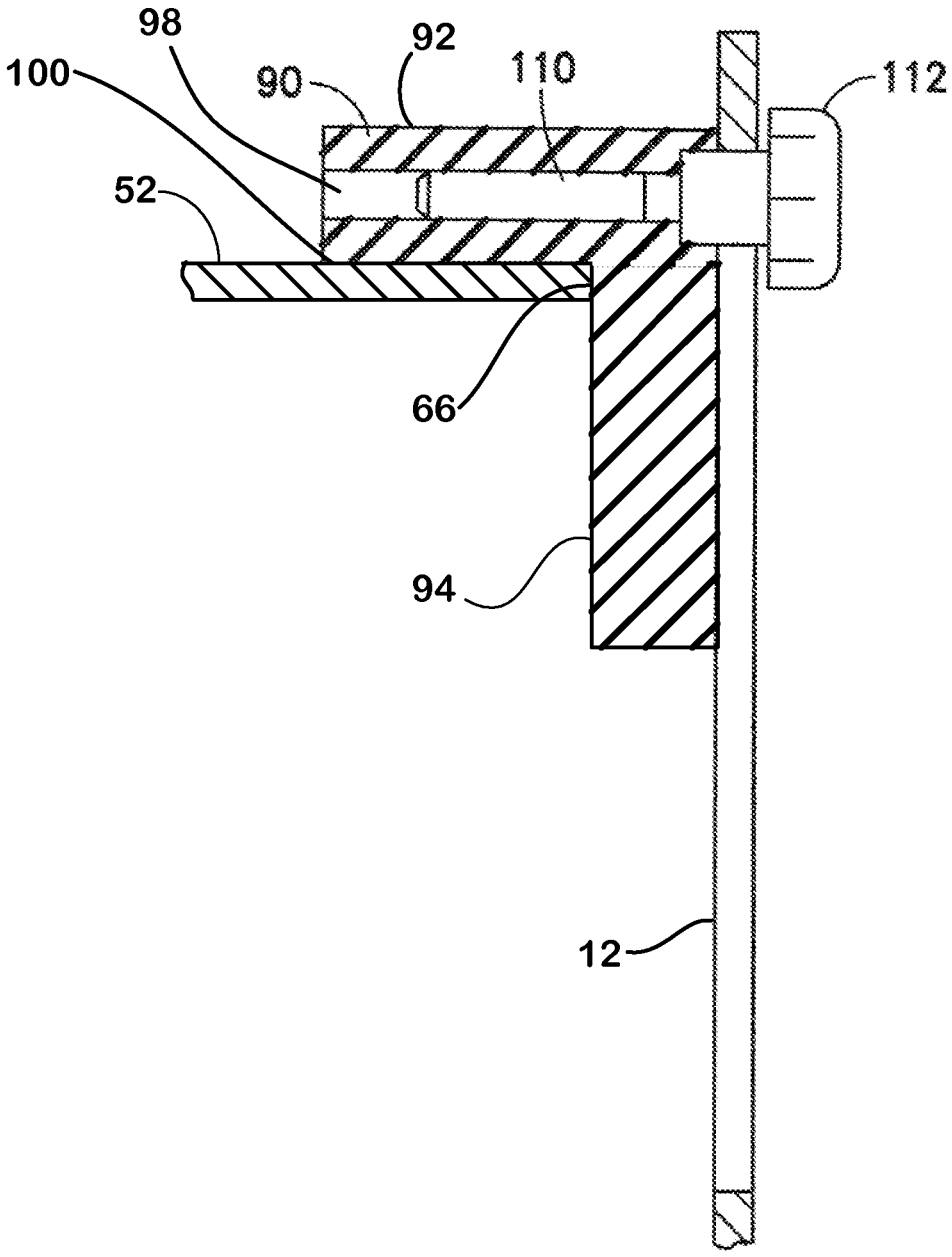
FIG. 11 is cross-sectional view taken along line 11-11 of FIG. 1.

The snow blower housing coupling fasteners 40 comprises carriage bolts 42 and knobs 44, and rubber mounts 46 for absorbing shock. The rubber mounts 46 are preferably rectangular and have a through hole 48 formed therein. The bolt 42 is inserted through the elongated slot 86 in the horizontal portion 82 of the bracket 70 and through the through hole 48 in the rubber mount 46. The bolt 42 extends through the openings 64 formed in the snow blower housing 52 and the rubber mount 46 is secured between the bracket 70 and the housing 52. The knob 44 is attached to the bolt 42 to facilitate fastening. In an alternate embodiment, as shown in FIGS. 8-9, the rubber mounts can have a sloped top surface 47 to properly nest with the snow blower housing 52. The rubber mounts 46 protect the plow attachment 10 and snow blower 50 housing 52 and absorb shock transmitted from the ground during operation.

Figure 12:
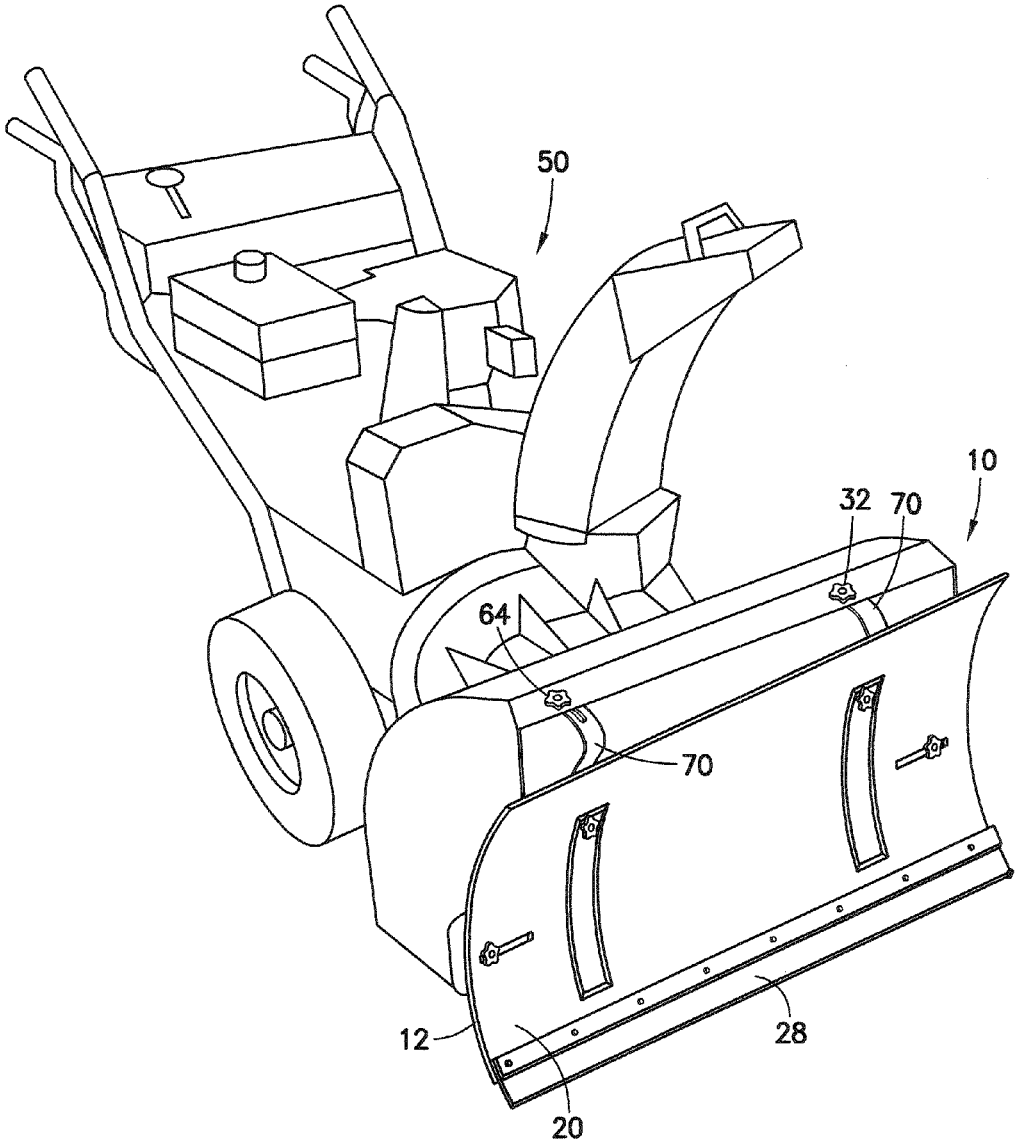
FIG. 12 is a perspective view of a removable plow attachment coupled to a snow blower and angled towards a side.

First and second L-shaped angling members 90 are mounted on the convex surface 22 of the plow member 12. The L-shaped angling members 90 have a wide portion 92 and a narrow portion 94 formed integrally at a substantially right angle. The wide portion 92 and the narrow portion 94 share a common side surface 96. However, the width of the wide portion 92 is greater than the width of the narrow portion 94. A through hole 98 extends through the L-shaped angling member 90 at the right angle. The wide portion 92 of the first and second L-shaped angling members 90 are aligned in proximity to and substantially parallel with the side edges 18 of plow member 12 so that the narrow portion 94 of the first L-shaped angling member 90 is facing the narrow portion 94 of the second L-shaped member 90. An L-shaped angling member fastening device 110 is threaded through the through hole 98 and a corresponding horizontal slot 25 formed in the plow member 12 so that an inner surface 100 of the wide portion 92 is in surface-to-surface contact with an exterior surface of the snow blower 50 housing 52 and the narrow portion 94 is sandwiched between the plow member 12 and the peripheral side edges 66 of the housing 52. A knob 112 is provided for securing the L-shaped angling member 90 to the plow member 12. The first and second L-shaped angling members 90 are rotated about the L-shaped angling member fastening device 110 to angle the plow attachment away from the housing 52 as shown in FIG. 12.

It is to be appreciated that although the plow attachment 10 is illustrated as being coupled to the housing 52 of the snow blower 50 with the carriage bolts 42, knobs 44 and rubber mounts 46, other coupling mechanisms or means are contemplated to be within the scope of the present disclosure. For example, a separate bracket may be provided to be permanently mounted to the housing 52 of the snow blower 50 and the plow attachment 12 is then provided with connection means to be coupled to the bracket.

Figure 3:
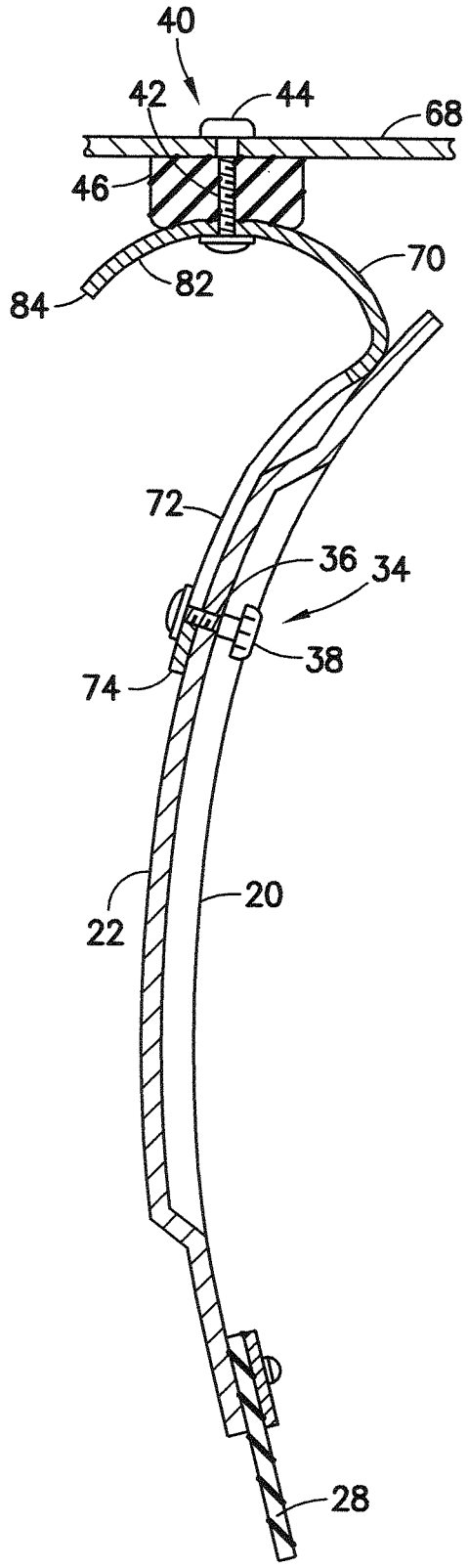
FIG. 3 is cross-sectional view taken along line 3-3 of FIG. 1.
Figure 4:
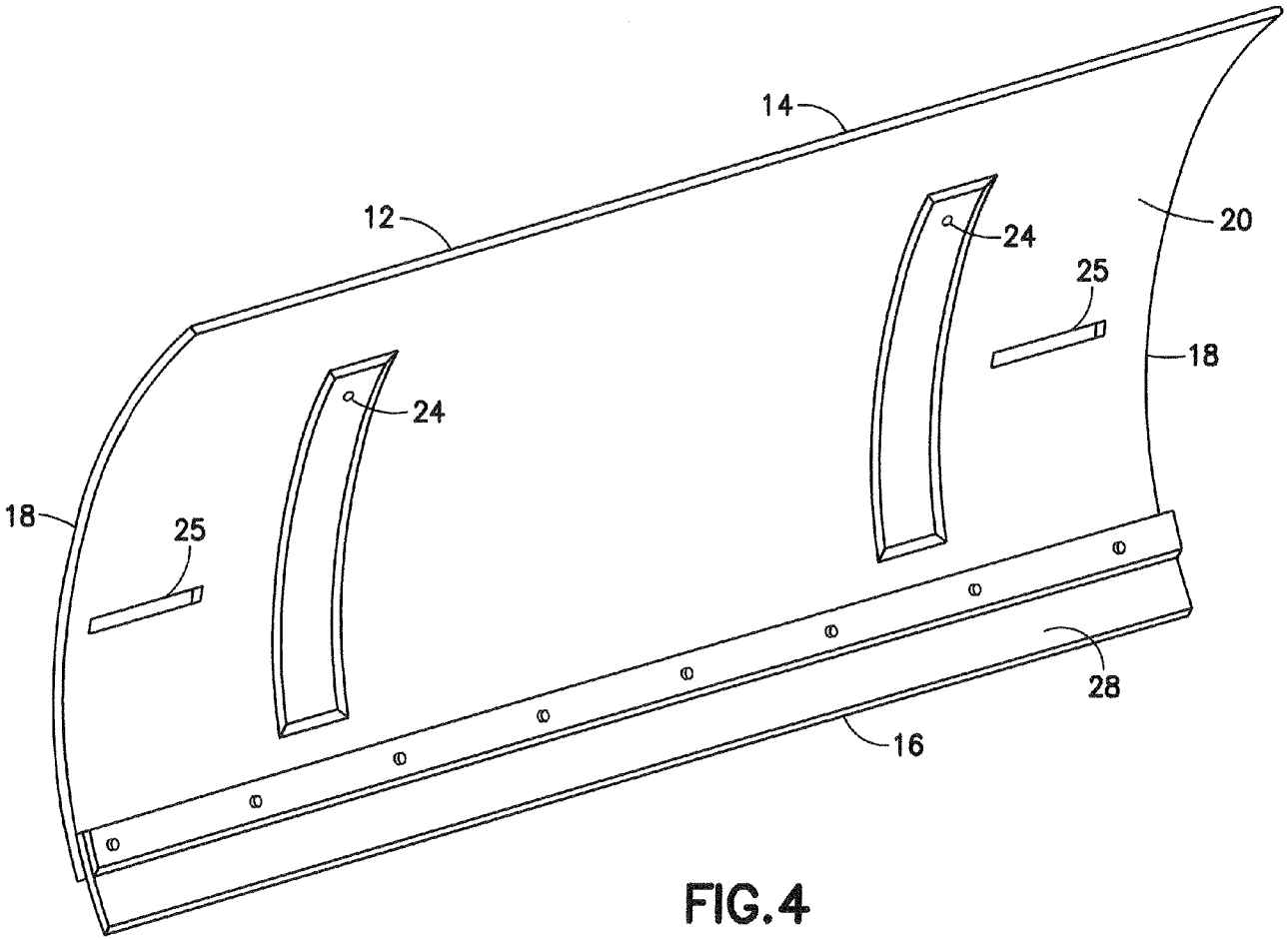
FIG. 4 is a perspective view of a plow member in accordance with an embodiment of the present disclosure.
Figure 5:
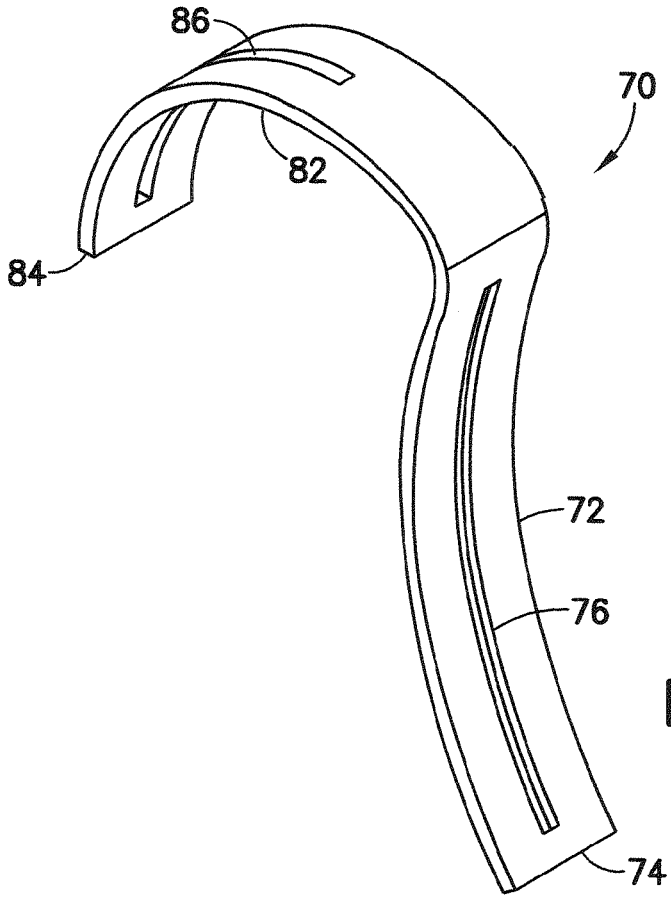
FIG. 5 is a perspective view of a hook-shaped bracket in accordance with an embodiment of the present disclosure.
Figure 6:
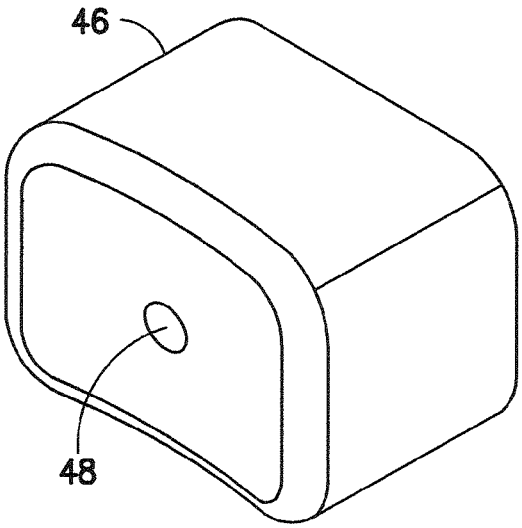
FIG. 6 is a perspective view of a rubber mount in accordance with an embodiment of the present disclosure.
Figure 7:
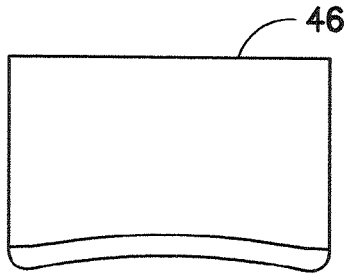
FIG. 7 is a side view of the rubber mount of FIG. 6.

Referring to FIG. 3, a side view of the plow attachment 10 is illustrated coupled to the housing 50. The height of the plow attachment 10 is adjustable via the fasteners 32 and hook shaped brackets 70. When the height is required to be small, the fasteners 32 are loosened and the plow member 12 is adjusted downward so that the fasteners 32 slide to an upper portion of the elongated slots 76 and are subsequently tightened. When the height is required to be larger, the fasteners 32 are loosened and the plow member 24 is adjusted upward, wherein the fasteners 32 slide to a lower portion of the elongated slots 76 and are subsequently tightened.

It is to be appreciated that the plow member 12 may be made from plastic or a light weight metal material such as aluminum. Additionally, the brackets 70 may also be constructed from a light weight metal material such as aluminum. In this manner, the overall weight of the plow attachment 10 can be kept relatively low for easy attachment and removal. Other materials, for both the plow attachment 12 and brackets 70, are contemplated to be within the scope of the present disclosure.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . ." or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

What is claimed is:

1. A plow attachment for a snow blower, the plow attachment comprising:

an arcuate plow member having a concave front surface and a convex rear surface, top and bottom edges, and left and right side edges extending between the top and bottom edges, first and second openings formed between the top and bottom edges and spaced inward from the side edges;

left and right hook-shaped brackets each having a plow-mounting leg and a blower-mounting leg angularly aligned to one another, an elongated plow-mounting slot formed in each of the plow mounting legs of the left and right hook-shaped brackets and an elongated blower mounting slot formed in each of the blower-mounting legs of the left and right hook-shaped brackets;

first and second plow member fastening portions for removably fastening the left and right hook-shaped brackets to the plow member, the first and second plow member fastening portions being configured for insertion through the elongated plow-mounting slots in the plow-mounting legs of the left and right hook-shaped bracket member and the opening formed in the plow member;

first and second snow blower fastening portions for removably coupling the left and right hook-shaped brackets to the snow blower, the first and second snow blower fastening portions being configured to be inserted through the elongated blower-mounting slots in the blower mounting legs of the left and right hook-shaped bracket members and through openings formed in the snow blower;

left and right L-shaped angling members mounted on a rear surface of the plow member in proximity to the left and right edges thereof, each of the L-shaped angling members having a wide portion with opposite ends spaced apart along a front-to-rear direction and a narrow portion extending from one of the ends of the wide portion to define a corner, a hole formed in the wide portion in proximity to the corner and extending in the front-to-rear direction at a position aligned with the narrow portion; and a bolt extending into the hole and rotatably coupling the L-shaped angling member to the rear surface of the plow member, wherein each of the left and right L-shaped angling members are independently rotatable about the bolt for adjusting a spacing between the plow member and the snow blower depending on orientations of the wide and narrow portions relative to the plow member and the snow blower.

2. The plow attachment of claim 1, wherein the first and second plow member fastening portions comprise first and second carriage bolts configured to be inserted through the elongated slots in the vertical portions of the hook-shaped bracket and the first and second openings formed in the plow member, and first and second knobs configured to be coupled to the first and second carriage bolts for fastening the left and right hook-shaped brackets to the plow member.

3. The plow attachment of claim 1, wherein the first and second snow blower fastening portions comprise first and second carriage bolts configured to be inserted through the elongated slot in the horizontal portion of the bracket and the openings in the snow blower, first and second knobs for securely fastening the hook-shaped brackets to the snow blower, and first and second rubber mounts, the first and second rubber mounts are configured to be sandwiched between the snow blower and the bracket.

4. The plow attachment of claim 1, further comprising a rubber member extending along the bottom edge of the plow member and extending towards a surface to be plowed.

5. The plow attachment of claim 1, wherein the vertical portion of the hook-shaped bracket member is an arcuate member and a rear convex surface of the plow member is configured to nest in the vertical portion when the plow member is coupled to the hook-shaped bracket.

6. The plow attachment of claim 4, wherein a height of the rubber member relative to the surface to be plowed is adjustable.

7. A snow blowing and plowing apparatus, the apparatus comprising:

a snow blower having a housing containing a rotating spiral blade driven by an engine, the housing having an open front end defined by top peripheral edge and two side peripheral edges and having two openings formed in a top surface in proximity to the top peripheral edge;

a plow attachment comprising an arcuate plow member having a concave front surface and a convex rear surface, parallel top and bottom edges and left and right side edges extending between the top and bottom edges, first and second openings formed between the top and bottom edges and spaced inward from the left and right side edges; and left and right hook-shaped brackets each having a plow mounting leg and a blower mounting leg angularly aligned to one another, an elongated plow-mounting slot formed in each of the plow mounting legs and an elongated blower-mounting slot formed in each of the blower-mounting legs of the left and right hook-shaped brackets;

first and second plow member fastening portions for removably fastening the left and right hook-shaped brackets to the plow member, the first and second plow member fastening portions being configured for insertion through the elongated plow-mounting slots in the plow-mounting legs of the left and right hook-shaped bracket member and the opening formed in the plow member;

first and second snow blower fastening portions for removably coupling the left and right hook-shaped brackets to the snow blower, the first and second snow blower fastening portions being configured to be inserted through the elongated blower-mounting slots in the blower-mounting legs of the left and right hook-shaped bracket members and through the openings formed in the top surface of the snow blower housing; and left and right L-shaped angling members mounted on a rear surface of the low member in proximity to the left and right edges thereof, each of the L-shaped angling members having a wide portion with opposite ends spaced apart along a front-to-rear direction and a narrow portion extending from one of the ends of the wide portion to define a corner, a hole formed in the wide portion in proximity to the corner and extending in the front-to-rear direction at a position aligned with the narrow portion; and a bolt extending into the hole and rotatably coupling the L-shaped angling member to the rear surface of the plow member, wherein each of the left and right L-shaped angling members are independently rotatable about the bolt for adjusting a spacing between the plow member and the snow blower depending on orientations of the wide and narrow portions relative to the plow member and the snow blower.

8. The apparatus of claim 7, wherein the first and second plow member fastening portions comprise first and second carriage bolts configured to be inserted through the elongated slots in the vertical portions of the hook-shaped bracket and the first and second openings formed in the plow member, and first and second knobs configured to be coupled to the first and second carriage bolts for fastening the left and right hook-shaped brackets to the plow member.

9. The apparatus of claim 7, wherein the first and second snow blower fastening portions comprise first and second carriage bolts configured to be inserted through the elongated slot in the horizontal portion of the bracket and the openings in the snow blower, first and second knobs for securely fastening the hook-shaped brackets to the snow blower, and first and second rubber mounts, the first and second rubber mounts are configured to be sandwiched between the snow blower and the bracket.

10. The apparatus of claim 7, further comprising a rubber member extending along the bottom edge of the plow member and extending towards a surface to be plowed.

11. The apparatus of claim 7, wherein the vertical portion of the hook-shaped bracket member is an arcuate member and a rear convex surface of the plow member is configured to nest in the vertical portion when the plow member is coupled to the hook-shaped bracket.

12. The apparatus of claim 7, wherein the horizontal portion of the hook-shaped bracket member is an arcuate member and is configured to nest with an inner surface of the snow blower housing.

13. The apparatus of claim 10, wherein a height of the rubber member relative to the surface to be plowed is adjustable.

14. A plow attachment for a snow blower, the snow blower having a housing containing a rotating spiral blade driven by an engine, the housing having an open front end defined by top peripheral edge and two side peripheral edges, the plow attachment comprising:

an arcuate plow member having a concave front surface and a convex rear surface, top and bottom edges, and left and right side edges extending between the top and bottom edges, first and second openings formed between the top and bottom edges and spaced inward from the side edges;

left and right brackets each having a plow-mounting leg and a blower-mounting leg angularly aligned to one another, an elongated plow-mounting slot formed in each of the plow mounting legs configured for adjustably coupling each bracket to the first and second openings of the plow member, and an elongated blower mounting slot formed in each of the blower-mounting legs configured for adjustably coupling each bracket to the top peripheral edge of the housing; and left and right angling members mounted on a rear surface of the plow member in proximity to the left and right edges thereof, wherein each of the left and right angling members are independently rotatable for adjusting a spacing between the left and right edges of the plow member and respective side peripheral edges of the housing of the snow blower depending on orientations of the left and right angling members.

* * * * *